United States Patent [19]

Mitsui et al.

[11] Patent Number: 4,996,422

[45] Date of Patent: Feb. 26, 1991

[54] MASS SPECTROMETER

[75] Inventors: Yasuhiro Mitsui, Fuchu; Keiji Hasumi, Iruma; Shinichiro Watase; Katsumi Kuriyama, both of Koganei; Kazuo Nakano, Kokubunji, all of Japan

[73] Assignees: Hitachi, Ltd., Tokyo; Hitachi Tokyo Electronics Co., Ltd., Ome, both of Japan

[21] Appl. No.: 360,107

[22] Filed: Jun. 1, 1989

[30] Foreign Application Priority Data

Jun. 1, 1988 [JP] Japan ..... 63-132765

[51] Int. Cl.[5] ..... H01J 44/06

[52] U.S. Cl. ..... 250/281; 250/283; 250/299; 250/397

[58] Field of Search ..... 250/281, 397, 292, 299, 250/283, 289, 489; 313/146, 147

[56] References Cited

U.S. PATENT DOCUMENTS

| | | | |
|---|---|---|---|
| 3,898,456 | 8/1975 | Dietz | 250/281 |
| 4,136,280 | 1/1979 | Hunt et al. | 250/292 |
| 4,423,324 | 12/1983 | Stafford | 250/281 |
| 4,507,555 | 3/1985 | Chang | 250/281 |
| 4,755,669 | 7/1988 | Grant et al. | 250/281 |
| 4,810,1882 | 3/1989 | Bateman | 250/281 |

OTHER PUBLICATIONS

Rev. Sci Instrum., vol 44, No. 4, Sep. 1978, pp. 1250–1256, American Institute of Physics; L. A. Diert et al: "Electron Multiplier-Scintillator Detector for Pulse Counting Positive or Negative Ion".

International Journal of Mode Spectrometry and Ion Physics, vol. 10, 1972–1973, pp. 85–105, Elsevier Publishing Co., "Field Ionization Mass Spectrometry using a Scintilation Detector".

J. of Mass Spectrometry and Ion Physics, vol. 33, No. 1, Feb. 1980, pp. 45–55, Elsevier Scientific Publishing Co., Amsterdam, NL; D. L. Donohue et al., "An Electro-Optical Ion Detector for Spark Source Mass Spectrometry".

*Primary Examiner*—Jack I. Berman
*Assistant Examiner*—Kiet T. Nguyen
*Attorney, Agent, or Firm*—Antonelli, Terry, Stout & Kraus

[57] ABSTRACT

A mass spectrometer, including an evacuable vessle, mass separation means provided in the evacuable vessel for separating ions in accordance with the mass thereof, and ion detection means provided in the evacuable vessel for detecting ions emitted from the mass separation means to convert the emitted ions into an electric signal, in which the ion detection means includes an electron-multiplier for detecting positive ions and a photo-multiplier for detecting negative ions. According to this mass spectrometer, positive ions can be detected at high sensitivity, and negative ions are readily detected.

11 Claims, 7 Drawing Sheets

MASS SPECTROMETER

BACKGROUND OF THE INVENTION

The present invention relates to a mass spectrometer, and more particularly to a mass spectrometer which is provided with an ion detector capable of detecting both a positive ion and a negative ion at high sensitivity.

A conventional ion detector included in mass spectrometers for detecting positive and negative ions is made up of an ion-electron converter, an electron-photon converter, and a photo-multiplier, as described in, for example, an article by H. Tamura et al. ("Shinku", Vol. 19, No. 8, 1976, pages 280 to 288).

The above ion detector can detect both a positive ion and a negative ion, but cannot avoid the generation of noise in the photo-multiplier. Accordingly, in a case where a positive ion is detected, the ion detector is inferior in detection sensitivity to the following ion detector capable of detecting only a positive ion.

Usually, a positive ion generated in a mass spectrometer is detected by an ion detector having the structure shown in FIG. 6A. FIG. 6B shows a potential relation among electrodes shown in FIG. 6A. Referring to FIG. 6A, positive ions which emerge from a mass separator 3 and have a desired mass, impinge on an ion-electron conversion surface 7 (namely, the cathode 7 of an electron-multiplier 8) applied with a large negative potential, to generate secondary electrons. The secondary electrons are multiplied by the electron-multiplier 8, and then sent to a data recording unit 19 in the form of a current signal. The electron-multiplier 8 generates extremely low noise, and hence is widely used for detecting and amplifying positive ions generated in mass spectrometers.

The electron-multiplier 8, however, cannot be used for detecting a negative ion for the following reason. In order to multiply the secondary electrons generated at the ion-electron conversion surface, it is necessary to make the potential of the cathode 7 lower than the potential of a current sending portion 9. The mass separator 3 and a slit 4 are applied with a ground potential. Thus, in order for a negative ion passing through the mass separator 3 to generate a secondary electron at the cathode 7, it is necessary to apply a large positive potential to the cathode 7, as shown in 6B. Since the current sending portion 9 (that is, the anode of the electron-multiplier 8) is applied with a potential higher than the potential of the cathode 7, the data recording unit 19 is obliged to be applied with a large positive potential. In order to solve this problem, a pulse count method is devised in which the direct connection of the anode 9 and the data recording unit 19 is avoided. The pulse count method, however, has the following disadvantage. When the ion optical system of an ion source 2 and the ion optical system between the ion source 2 and the electron-multiplier 8 are improved to increase ions capable of reaching the cathode 7, thereby enhancing ion detection sensitivity, it becomes impossible to detect all ions completely because of short pulse intervals. For example, a mass spectrometer capable of ionizing atoms and molecules under atmospheric pressure is a high-sensitivity analytical instrument, and is used for ultra trace detection. In order to determine ultra trace components, it is necessary to detect small peaks. According to the pulse count method, it is necessary to detect a main peak corresponding to a main component together with the small peaks. When the above ion optical systems are improved so as to increase ions capable of reaching the electron-multiplier 8, an ion current corresponding to the main component becomes greater than $10^{-10}$ A. Such a large ion current cannot be measured by the pulse count method.

In view of the above-mentioned facts, an ion detector with the structure shown in FIG. 7A has been used for detecting a negative ion. Referring to FIG. 7A, a negative ion is converted into an electron by an ion-electron converter 10 which is applied with a large positive potential, as indicated by a dotted line in FIG. 7B. The electron thus obtained is converted into a photon by an electron-photon converter 13 which is applied with a positive potential larger than the positive potential of the ion-electron converter 10. The photon from the electron-photon converter 13 is detected and amplified by a photo-multiplier 15, the output current of which is supplied to the data recording unit 19. The current sending portion 17 of the photo-multiplier 15 is applied with a ground potential. Thus, the data recording unit 19 can be applied with the ground potential.

When the ion-electron converter 10 and the electron-photon converter 13 are applied with a large negative potential and a large positive potential, respectively, as indicated by a solid line in FIG. 7B, the ion detector of FIG. 7A can detect a positive ion. That is, this ion detector can detect both a negative ion and a positive ion.

The ion detector of FIG. 7A, however, has the following drawback. The photo-multiplier 15 is more readily affected by stray light, cosmic rays and others than the electron-multiplier 8 of FIG. 6A, that is, noise is readily generated in the photo-multiplier 15. Hence, the ion detector of FIG. 7A is inferior in signal-to-noise ratio to the positive ion detector of FIG. 6A, and thus cannot detect trace ions.

In order to detect a negative ion by the ion detector of FIG. 7A after a positive ion has been detected by the ion detector of FIG. 6A, it is required to replace the ion detector of FIG. 6A by the ion detector of FIG. 7A. Further, in order to detect a positive ion at high sensitivity by the ion detector of FIG. 6A after a negative ion has been detected by the ion detector of FIG. 7A, it is required to replace the ion detector of FIG. 7A by the ion detector of FIG. 6A. The substitution of one of the ion detectors of FIG. 6A and 7A for the other ion detector is cumbersome, and requires a long time. Hence, it is practically impossible to carry out the above substitution frequently.

SUMMARY OF THE INVENTION

It is an object of the present invention to provide a mass spectrometer provided with an ion detector which can not only detect a positive ion at high sensitivity but also can detect a negative ion.

In order to attain the above object, according to the present invention, there is provided a mass spectrometer, in which, as shown in FIGS. 1A and 2A, an electron-multiplier 8 for detecting a positive ion and a photo-multiplier 15 for detecting a negative ion are included in an evacuable vessel 1 together with a mass separator 3 in such a manner that the electron-multiplier 8 and the photo-multiplier 15 are disposed behind the mass separator 3.

As can be seen from FIGS. 2A and 2B, positive ions 27 having passed through the mass separator 3 are accelerated by a large negative potential applied to the cathode 7 of the electron-multiplier 8, and then impinge on the cathode 7 to generate secondary electrons. The secondary electrons thus obtained are multiplied by the electron-multiplier 8, to be detected as a current signal, which is sent to a data recording unit 19. Further, as can be seen from FIGS. 1A and 1B, negative ions 26 are detected by an ion-electron converter 10, an electron-photon converter 13, and a photo-multiplier 15 which are all disposed in the evacuable vessel 1. In more detail, the negative ions 26 having passed through the mass separator 3 are accelerated by the potential gradient between the ion-electron converter 10 applied with a large positive potential and the mass separator 3, in a direction toward the ion-electron converter, and then impinge on the ion-electron converter 10 to generate electrons. The electrons thus generated are accelerated in a direction toward the electron-photon converter 13 applied with a positive potential far larger than the potential of the ion-electron converter 10, and are then introduced into the electron-photon converter 13 to generate photons. The photons from the electron-photon converter 13 are converted by the photoelectric conversion surface of the photo-multiplier 15 into photoelectrons, which are multiplied by the photo-multiplier 15. A current signal corresponding to the amount of negative ion is sent from the photo-multiplier 15 to the data recording unit 19.

As mentioned above, the electron-multiplier 8 for detecting a positive ion and the photo-multiplier 15 for detecting a negative ion are both disposed in the evacuable vessel 1. Thus, not only the positive ion can be detected at high sensitivity, but also the negative ion can be detected. However, owing to the size and shape of each of the electron-multiplier 8 and the photo-multiplier 15, it is very difficult to dispose the electron-multiplier 8 and the photo-multiplier 15 fixedly in the evacuable vessel 1 so that the amount of ion detected by each of the electron-multiplier 8 and the photo-multiplier 15 becomes maximum.

In order to solve this problem, according to the present invention, the electron-multiplier 8 and the photo-multiplier 15 are moved in the evacuated vessel 1 by a moving mechanism provided outside of the vessel 1 so that each of the electron multiplier 8 and the photo-multiplier 15 is placed at an optimum position for an ion trajectory. Thus, unlike the conventional ion detector for detecting both a positive ion and a negative ion, a mass spectrometer according to the present invention can detect a positive ion without reducing a signal-to-noise ratio.

DESCRIPTION OF THE PREFERRED EMBODIMENTS

Now, explanation will be made of an embodiment of a mass spectrometer according to the present invention, with reference to FIGS. 1A, 1B, 2A and 2B.

Figure 1A:
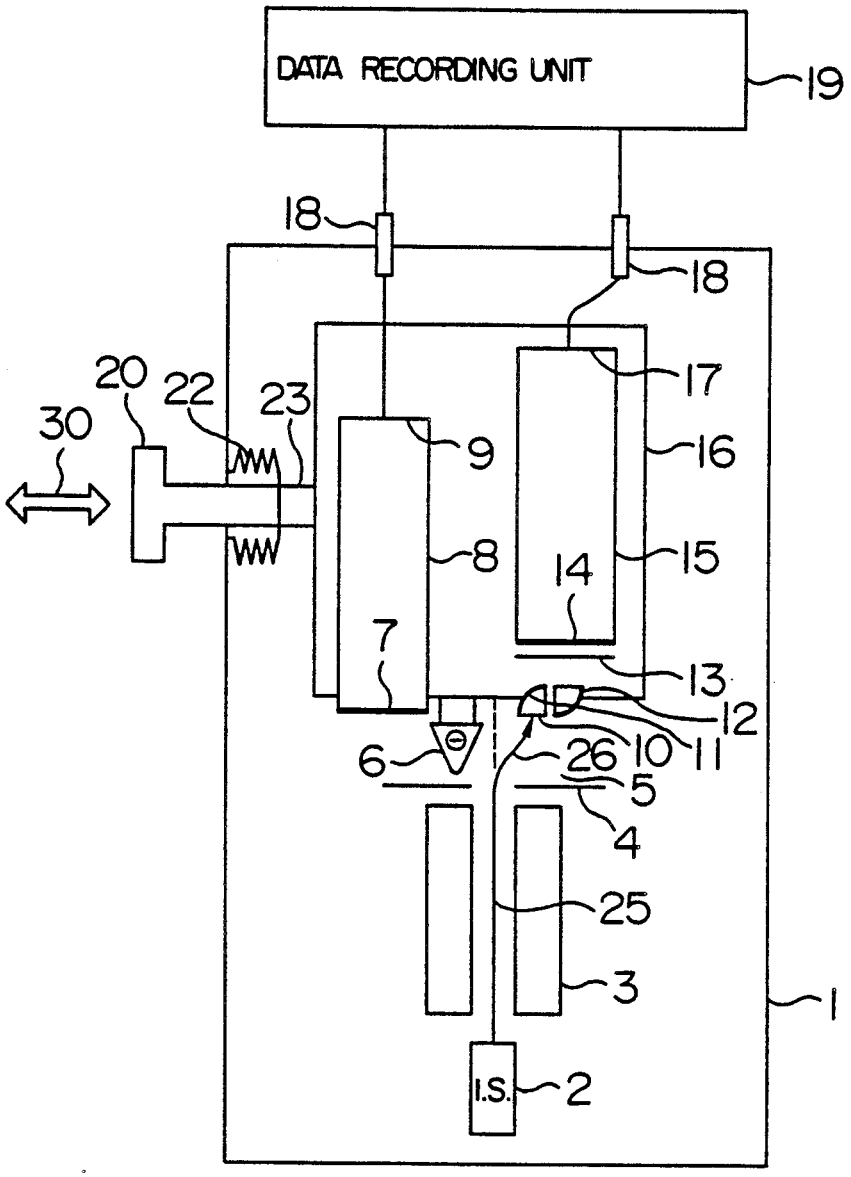
FIGS. 1A and 2A are schematic diagrams showing an embodiment of a mass spectrometer according to the present invention.

Referring to FIG. 1A, the electron-multiplier 8 and the photo-multiplier 15 are disposed in the evacuable vessel 1 so that these multipliers are parallel to each other. Further, the electron-multiplier 8, a deflector 6, the ion-electron converter 10, the electron-photon converter (that is, scintillator) 13, and the photo-multiplier 15 are all fixed to the surface of a movable mount 16. The movable mount 16 is connected to a moving mechanism 20 which is provided outside of the evacuable vessel 1, through a connecting rod 23 and bellows 22. By operating the moving mechanism 20 from the outside of the evacuable vessel 1, the movable mount 16 is moved in directions 30 indicated by arrows.

Figure 1B:
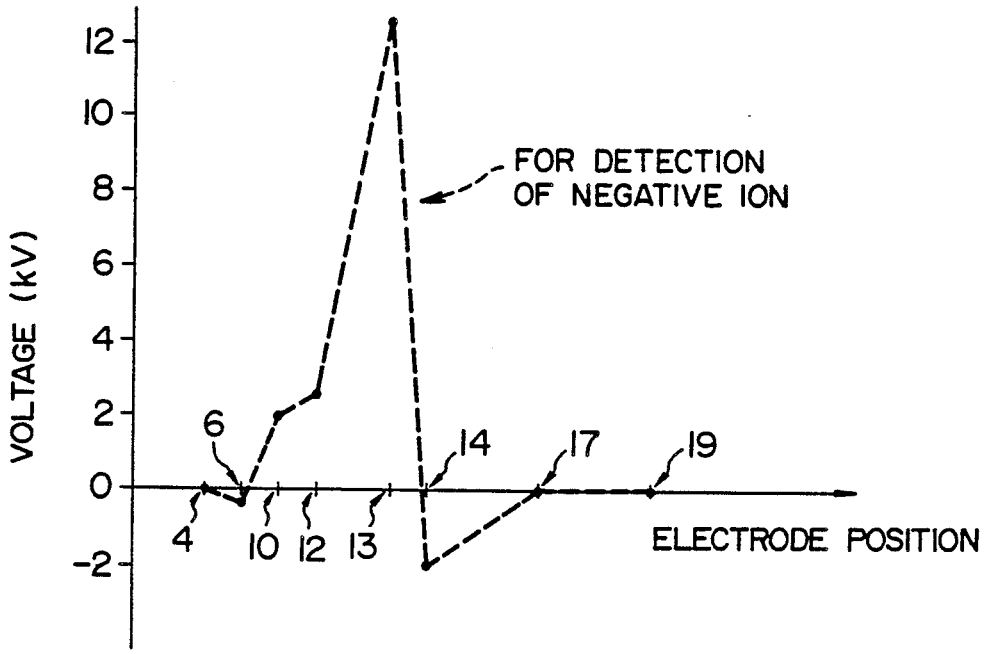
FIG. 1B is a graph showing a potential relation among electrodes in the arrangement of FIG. 1A.

First, explanation will be made of a case where negative ions are detected, with reference to FIGS. 1A and 1B. Referring to FIG. 1A, negative ions 26 which have been taken out from an ion source 2 and have passed through the mass separator 3 and a slit 4, are deflected toward the ion-electron converter 10 by the deflector 6 applied with a negative potential, and are accelerated by a large positive potential applied to the ion-electron converter 10, to impinge on the ion-electron conversion surface 11 of the converter 10, thereby generating electrons. The electrons thus obtained are amplified by an electron amplifier 12, and then accelerated by the electron-photon converter (namely, scintillator) 13 having a positive potential higher than the potential of the electron amplifier 12, to be introduced into the scintillator 13. The electron introduced in the scintillator 13 are converted into photons. The photons from the scintillator 13 are converted into electrons by the photo-electric conversion surface 14 of the photo-multiplier 15. The electrons thus generated are multiplied by the photo-multiplier 15, to produce a signal current, which is supplied to the data recording unit 19 through a current supplying terminal 18. As mentioned above, not electrons but photons travel between the scintillator 13 and the photoelectric conversion surface 14, that is, a light propagation space is formed between the scintillator 13 and the photo-multiplier 15. Thus, it is not required to establish an electric field between the scintillator 13 and the photo-multiplier 15, and hence the potential of the current sending portion 17 of the photo-multiplier 15 can be made equal to a ground potential.

Figure 2A:
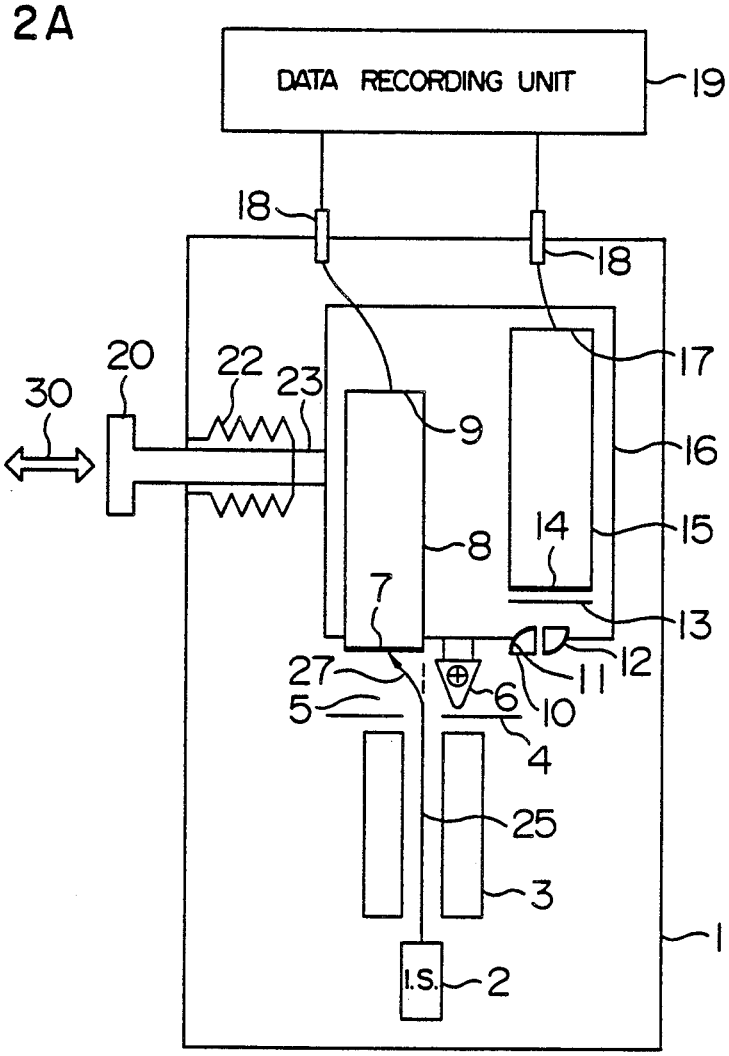
Figure 2B:
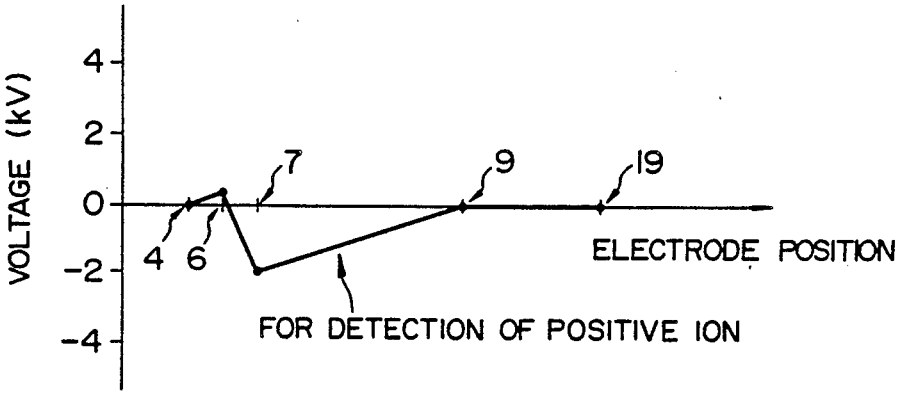
FIG. 2B is a graph showing a potential relation among electrodes in the arrangement of FIG. 2A.

Next, explanation will be made of a case where positive ions are detected, with reference to FIGS. 2A and 2B. In this case, the deflector 6 is applied with a positive potential, to deflect positive ions 27 toward the ion-electron conversion surface 7 of the electron-multiplier 8. The deflected positive ions 27 impinge on the ion-electron conversion surface 7, to generate electrons. The electrons thus generated are multiplied by the electron-multiplier 8, to produce a signal current, which is supplied to the data recording unit 19 through another current supplying terminal 18.

As mentioned above, the present embodiment can detect both a negative ion and a positive ion. It is to be noted that the arrangement of FIG. 1A is different from that of FIG. 2A in position of the movable mount 16.

Figure 6A:
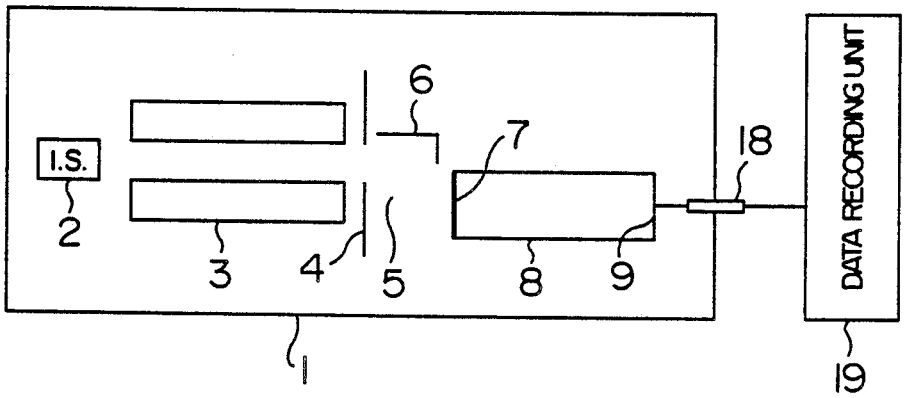
FIG. 6A is a schematic diagram showing a conventional mass spectrometer capable of detecting only a positive ion.
Figure 6B:
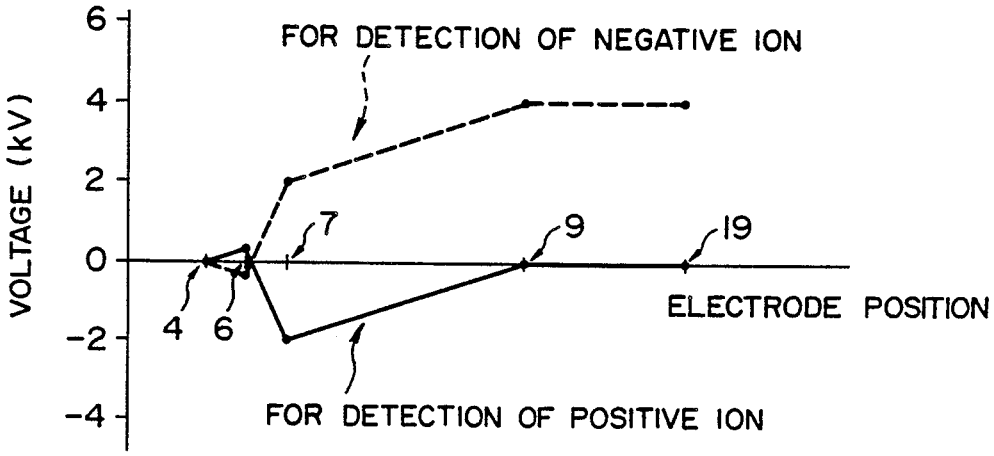
FIG. 6B is a graph showing potential relations among electrodes of the mass spectrometer of FIG. 6A.
Figure 7A:
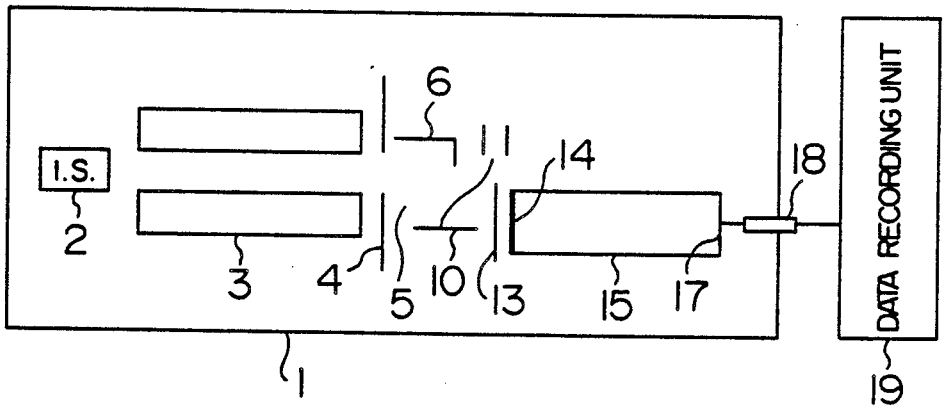
FIG. 7A is a schematic diagram showing another conventional mass spectrometer capable of detecting both a positive ion and a negative ion.
Figure 7B:
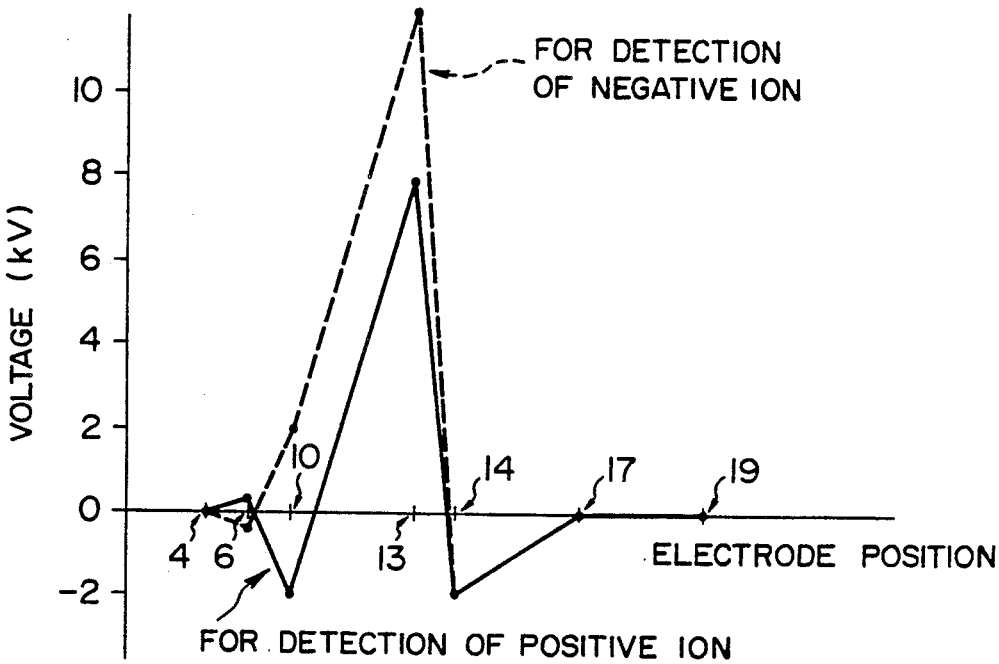
FIG. 7B is a graph showing potential relations among electrodes of the mass spectrometer of FIG. 7A.

Specifically, in a quadrupole mass spectrometer, excited neutral molecules pass through the mass separator 3, in addition to ions. When the excited neutral molecules impinge on one of the ion-electron conversion surfaces 7 and 11, electrons are generated. The electrons due to the neutral molecules are added to the electrons due to ions, and thus act as a noise component in detecting the ions. In other words, the excited neutral molecules incident on one of the ion-electron conversion surfaces 7 and 11 reduce the ion detection sensitivity. As shown in FIGS. 6A and 7A, in order to prevent the excited neutral molecules from reaching the ion-electron conversion surface 7 or 11, the ion-electron conversion surface 7 or 11 is usually deviated from the axis of the ion beam passing through the mass separator 3, and only ions are deflected by the deflector 6. In the present embodiment, the electron-multiplier 8 and the photo-multiplier 15 are disposed in the same evacuable vessel 1. If the ion-electron conversion surface 7 can be placed at an optimum position for a positive ion trajectory and the ion-electron conversion surface 11 can be placed at an optimum position for a negative ion trajectory, it will be unnecessary to move the movable mount 16.

However, owing to the size of each of the electron-multiplier 8 and the photo-multiplier 15 and a high voltage which is applied to each of the ion-electron conversion surfaces 7 and 11 and may cause a discharge, it is required to make large the distance between the center axis 25 of the ion beam in the mass separator 3 and each ion-electron conversion surface 7 or 11. Accordingly, it is very difficult to place each of the ion-electron conversion surfaces 7 and 11 at an optimum position for an ion trajectory in such a manner that two ion detecting mechanisms are made parallel to each other within the evacuable vessel 1 and fixed relative to the evacuable vessel 1. The trajectory of the negative ions 26 and the trajectory of the positive ions 27 can be varied by the potential applied to the defector 6. When the distance between the slit 4 and each of the ion-electron conversion surfaces 7 and 11 is made large, the loss of ion in an electric-field generating region 5 is increased, and thus the ion detection sensitivity is reduced.

In view of the above facts, in the present embodiment, the moving mechanism 20 provided outside of the evacuable vessel 1 is operated to move the movable mount 16 in the evacuated vessel 1 so that each of the ion-electron conversion surfaces 7 and 11 is placed at an optimum position for an ion trajectory. An example of the moving mechanism 20 will be explained later, with reference to FIG. 5.

Figure 3:
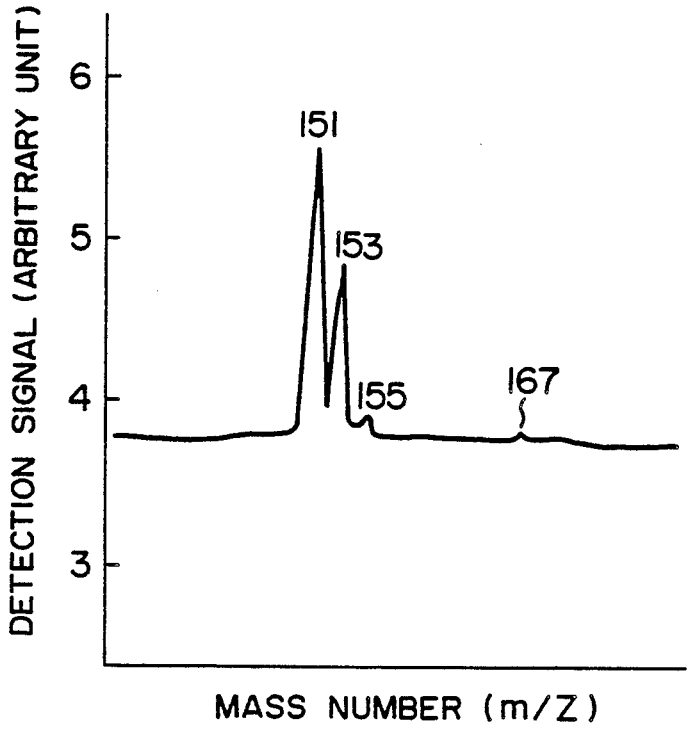
FIG. 3 is a graph showing a mass spectrum obtained by the embodiment of FIGS. 1A and 2A.
Figure 4:
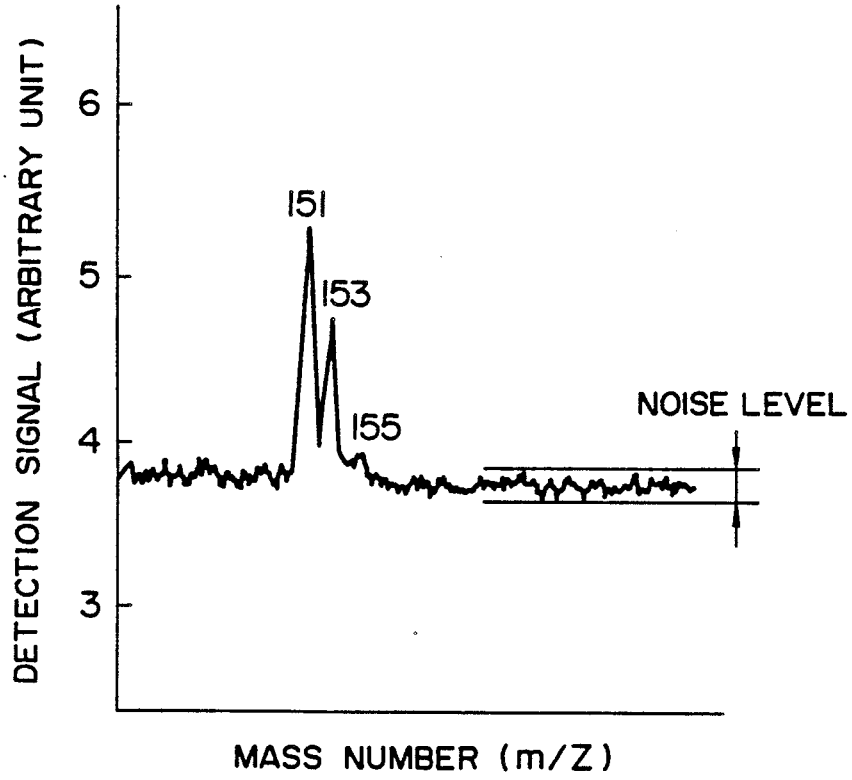
FIG. 4 is a graph showing a mass spectrum obtained by a conventional mass spectrometer.

FIG. 3 shows an example of a mass spectrum of positive ions detected by the present embodiment, and FIG. 4 shows a mass spectrum of positive ions which is obtained by the conventional ion detector shown in FIG. 7A for detecting positive and negative ions, and corresponds to the mass spectrum of FIG. 3. As is apparent from the comparison of FIG. 3 with FIG. 4, the mass spectrum obtained by the present embodiment is far lower in noise level than the mass spectrum obtained by the conventional ion detector. Further, the mass spectrum according to the present embodiment includes a peak having a mass number (namely, m/Z) of 167, but the mass spectrum according to the conventional ion detector cannot show the above peak.

As has been explained in the above, according to the present embodiment, a positive ion can be detected at high sensitivity, and a negative ion can be readily detected.

Figure 5:
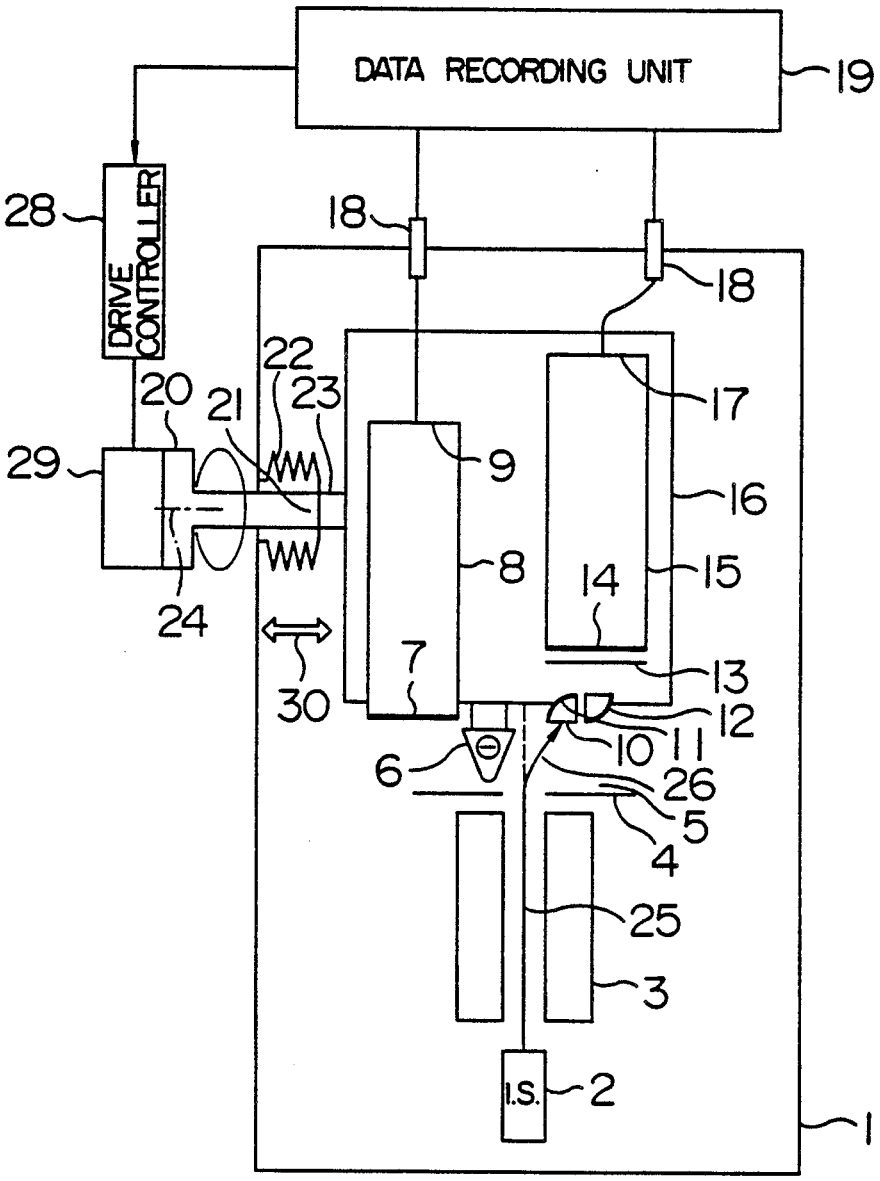
FIG. 5 is a schematic diagram showing another embodiment of a mass spectrometer according to the present invention.

FIG. 5 shows another embodiment of a mass spectrometer according to the present invention. The present embodiment is different from the embodiment of FIGS. 1A and 2A, in that the movable mount 16 is automatically moved. In the present embodiment, the movable mount 16 is moved with the aid of a rotary motion feed (that is, rotational feed mechanism) 20'. In more detail, when the rotary motion feed through 20' turns on an axis 24, the head portion 21 of the rotary motion feed 20' makes a linear motion in directions 30 indicated by arrows. The head portion 21 is fixed to the bellows 22, and the bellows 22 is connected to the movable mount 16 through the connecting rod 23. Thus, when the rotary motion feed 20' is rotated on the outside of the evaluable vessel 1, the movable mount 16 is moved in the directions 30. By using this movable-mount moving mechanism, the ion-electron conversion surfaces 7 and 11 can be placed at optimum positions for the positive and negative ion trajectories, respectively. Thus, the detection sensitivity for each of positive and negative ions can be enhanced. Further, the bellows 22 prevents the contaminant used in the rotary motion feed-through 20' such as lubricating oil, from being introduced into the evacuable vessel 1.

In the present embodiment, the rotary motion feed through 20' is driven by a driving motor 29, which is controlled by a drive controller 28. The signal current from one of the electron-multiplier 8 and the photo-multiplier 15 is analyzed by the data recording unit 19, and the positional information on the movable mount 16 for making the amount of detected ion maximum is sent to the drive controller 28. Thus, the movable mount 16 can be placed at an optimum position. That is, according to the present embodiment, a cumbersome operation for placing each of the ion-electron conversion surfaces 7 and 11 at an optimum position is automatically performed. Thus, each of positive and negative ions can be readily detected at maximum permissible sensitivity.

As has been explained in the foregoing, according to the present invention, a positive ion can be detected without being affected by radiation noise, and a negative ion can be readily detected. In more detail, in order to detect both a positive ion and a negative ion and to detect the positive ion at high sensitivity, a conventional mass spectrometer is required to include both a mass spectrometer only for positive ion and a mass spectrometer only for the negative ion, or the substitution of one of the positive ion detector and the negative ion detector for the other ion detector in an evacuated chamber is required. The present invention does not necessitate the above-mentioned, complicated structure, and can eliminate the cumbersome substitution.

We claim:

1. A mass spectrometer comprising:

an evacuable vessel;

mass separation means provided in the evacuable vessel for separating ions in accordance with the mass of the ions; and ion detection means provided in the evacuable vessel for detecting ions emitted from the mass separation means to convert the emitted ions into an electric signal;

wherein the ion detection means includes an electron-multiplier for detecting positive ions and a photo-multiplier for detecting negative ions; and wherein deflection means for varying an ion trajectory is disposed between the mass separation means and the ion detection means.

2. A mass spectrometer comprising:

mass separation means for separating ions in accordance with the mass of the ions and emitting the separated ions, wherein the emitted ions comprise at least one of positive ions and negative ions;

electron-multiplier means for detecting positive ions emitted from the mass separation means; and photo-multiplier means for detecting negative ions emitted from the mass separation means;

wherein the electron-multiplier means detects the positive ions emitted from the mass separation means at an optimum positive ion detecting position; and wherein the photo-multiplier means detects the negative ions emitted from the mass separation means at an optimum negative ion detecting position;

the mass spectrometer further comprising:

ion deflection means for deflecting the positive ions emitted from the mass separation means to the optimum positive ion detecting position, and for deflecting the negative ions emitted from the mass separation means to the optimum negative ion detecting position.

3. A mass spectrometer comprising:

an evacuable vessel;

mass separation means provided in the evacuable vessel for separating ions in accordance with the mass of the ions; and.

ion detection means provided in the evacuable vessel for detecting ions emitted from the mass separation means to convert the emitted ions into an electric signal;

wherein the ion detection means includes an electron-multiplier for detecting positive ions and a photo-multiplier for detecting negative ions;

the mass spectrometer further comprising:

means provided on the outside of the evacuable vessel for moving the electron-multiplier and the photo-multiplier within the evacuable vessel.

4. A mass spectrometer according to claim 2, wherein the electron-multiplier and the photo-multiplier are moved in a direction perpendicular to the trajectory of neutral particles emitted from the on separation means.

5. A mass spectrometer according to claim 2, wherein deflection means for varying an ion trajectory is disposed between the mass separation means and the ion detection means.

6. A mass spectrometer according to claim 3, wherein deflection means for varying an ion trajectory is disposed between the mass separation means and the ion detection means.

7. A mass spectrometer comprising:

mass separation means for separating ions in accordance with the mass of the ions and emitting the separated ions, wherein the emitted ions comprise at least one of positive ions and negative ions;

electron-multiplier means for detecting positive ions emitted from the mass separation means; and photo-multiplier means for detecting negative ions emitted from the mass separation means;

wherein the electron-multiplier means detects the positive ions emitted from the mass separation means at an optimum positive ion detecting position; and wherein the photo-multiplier means detects the negative ions emitted from the mass separation means at an optimum negative ion detecting position;

the mass spectrometer further comprising:

moving means for moving the electron-multiplier means to the optimum positive ion detecting position, and for moving the photo-multiplier means to the optimum negative ion detecting position.

8. A mass spectrometer according to claim 7, wherein the mass separation means also emits neutral particles, and wherein the moving means moves the electron-multiplier means and the photo-multiplier means in directions perpendicular to a trajectory of the neutral particles emitted from the mass separation means.

9. A mass spectrometer according to claim 7, further comprising ion deflection means for deflecting the positive ions emitted from the mass separation means to the optimum positive ion detecting position, and for deflecting the negative ions emitted from the mass separation means to the optimum negative ion detecting position.

10. A mass spectrometer according to claim 9, wherein the mass separation means also emits neutral particles, and wherein the moving means moves the electron-multiplier means and the photo-multiplier means in directions perpendicular to a trajectory of the neutral particles emitted from the mass separation means.

11. A mass spectrometer according to claim 10, further comprising evacuable vessel means, wherein the mass separation means, the electron-multiplier means, the photo-multiplier means, and the ion deflection means are disposed inside the evacuable vessel means, and wherein the moving means is disposed outside the evacuable vessel means.

* * * * *